US010386105B2

(12) United States Patent
Schoonen

(10) Patent No.: US 10,386,105 B2
(45) Date of Patent: Aug. 20, 2019

(54) ICE CUBE MAKER

(71) Applicant: W. SCHOONEN BEHEER B.V., Nuenen (NL)

(72) Inventor: Wilhelmus Franciskus Schoonen, Nuenen (NL)

(73) Assignee: W. SCHOONEN BEHEER B.V., Nuenen (NL)

( * ) Notice: Subject to any disclaimer, the term of this patent is extended or adjusted under 35 U.S.C. 154(b) by 123 days.

(21) Appl. No.: 14/894,149

(22) PCT Filed: May 13, 2014

(86) PCT No.: PCT/NL2014/050300

§ 371 (c)(1),
(2) Date: Nov. 25, 2015

(87) PCT Pub. No.: WO2014/193222

PCT Pub. Date: Dec. 4, 2014

(65) Prior Publication Data

US 2016/0131406 A1 May 12, 2016

(30) Foreign Application Priority Data

May 28, 2013 (EP) ..... 13169509

(51) Int. Cl.
*F25C 5/02* (2006.01)
*F25C 1/04* (2018.01)
(Continued)

(52) U.S. Cl.
CPC ..... *F25C 1/04* (2013.01); *F25C 1/06* (2013.01); *F25C 1/22* (2013.01); *F25C 2400/06* (2013.01)

(58) Field of Classification Search
CPC ..... F25C 1/04; F25C 1/06; F25C 1/22; F25C 1/10; F25C 5/08; F25C 2400/04; F25C 5/04; F25C 5/20; F25C 2305/022
See application file for complete search history.

(56) References Cited

U.S. PATENT DOCUMENTS 2,435,285 A 2/1948 Lucia
2,900,803 A 8/1959 Horton, Jr.
(Continued)

FOREIGN PATENT DOCUMENTS

CN 2485606 Y 4/2002
EP 0 132 412 A2 1/1985
(Continued)

OTHER PUBLICATIONS

International Search Report, dated Jun. 25, 2014, from corresponding PCT application.

*Primary Examiner* — Keith M Raymond
*Assistant Examiner* — Kamran Tavakoldavani
(74) *Attorney, Agent, or Firm* — Young & Thompson

(57) ABSTRACT

An apparatus for making ice cubes includes a plurality of elongated elements (1, 2). A plurality of mold parts (3, 4, 5, 6) are movable with respect to the elongated elements (1, 2). The plurality of mold parts are movable to form a mold (7) around a first elongated element (1) of the elongated elements. A control unit is configured to control a movement of the plurality of mold parts with respect to the elongated elements to move the mold parts (3, 5) forming the mold (7) around the first elongated element (1) apart once a first ice column (201) has been formed in the mold (7), and form a mold (8) around a second elongated element (2) of the elongated elements. An ice remover (202) is configured to remove the first ice column (201).

20 Claims, 6 Drawing Sheets

(51) Int. Cl.
*F25C 1/06* (2006.01)
*F25C 1/22* (2018.01)

(56) References Cited

U.S. PATENT DOCUMENTS 4,429,550 A * 2/1984 Latter ..... F25C 1/04 62/353
4,800,731 A * 1/1989 Cole ..... F25C 1/04 62/233
4,903,506 A 2/1990 Delisle et al.
5,471,853 A 12/1995 Shih
5,829,266 A * 11/1998 Lyu ..... F25C 1/04 62/353
6,857,277 B2 * 2/2005 Somura ..... F25C 1/18 249/92
8,240,519 B2 8/2012 Buchstab et al.
9,151,527 B2 * 10/2015 Boarman ..... F25C 1/18
2004/0093878 A1 5/2004 Sanuki et al.
2009/0308085 A1 * 12/2009 DeVos ..... F25C 1/10 62/73
2013/0081412 A1 * 4/2013 Son ..... F25C 1/04 62/73

FOREIGN PATENT DOCUMENTS

FR 827 363 A 4/1938
JP 4112096 U 9/1992
JP 05322398 A 12/1993
JP 735968 U 4/1995
JP 8042944 A2 2/1996
JP 09033150 A 2/1997
JP 10197114 A 7/1998
JP 2003130513 A 5/2003
JP 2003 287327 A 10/2003
JP 2006052935 A2 2/2006
WO 2008/131770 A1 11/2008
WO 2009/005339 A2 1/2009

* cited by examiner 401
402
403
404
405
406
407
408
409
410
411
412
501
502
503
504
505
506
507
508
509

ICE CUBE MAKER

FIELD OF THE INVENTION

The invention relates to an apparatus for making ice cubes. More particularly, the invention relates to an apparatus for making and dispensing ice cubes. Moreover, the invention relates to a method of making ice cubes.

BACKGROUND OF THE INVENTION

Generally, an ice cube maker is used to freeze water or other liquid in form of ice cubes. Such ice cube makers are widely employed in household appliances, drinking establishments, restaurants as for example fast food restaurants, catering industry, etc. The ice cubes generated by the ice cube maker often should be dispensed, for example in a glass for cooling a liquid which is contained in the glass. In this kind of industry, it is known to use refrigerators including a storage compartment for storing the ice cubes. However, usually the dimensions of such kind of refrigerators are big, therefore using a large amount of space in the establishments wherein they are used.

The user, for instance a barman, may pick up the ice cubes from the container using a pair of tongs for subsequently depositing them in a glass. This approach shows the drawback that the barman can more easily reach the ice cubes with his hand and that the ice cubes are continuously exposed to the ambient air in the establishment, which may be unhygienic. Another drawback of such a device is that the ice cubes stored may stick to each other, making it difficult for the barman to pick them up.

U.S. Pat. No. 8,240,519 B2 discloses an ice dispenser comprising a storage container for elements of ice and an output chamber having an ice outlet opening with a stirrer rotator for dispensing the ice cubes. However, with such a device it is difficult to meter the number of ice cubes and it does not solve the problem of the ice cubes sticking together in the storage container. In addition, there is a danger that the ice cubes will get jammed in front of or in the discharge opening and block it.

WO 2009/005339 discloses a device for making ice cubes, comprising a supplying device for supplying a liquid substance to at least one elongated mould and a refrigerating device for freezing said liquid substance, which at least one mould defines a space for an ice column which is at least substantially closed at least while said liquid substance is being refrigerated, wherein said at least one mould comprises two mould halves which are movable relative to each other, so that the mould halves can be moved apart once the ice column has been formed. Said at least one mould may comprise heating means for detaching the obtained ice column from the mould by melting. Said at least one mould may define a series of interconnected, hollow spaces for forming an elongated ice column of interconnected ice cubes. Agitation means may be provided for agitating the liquid mass while it is being refrigerated in said at least one elongated mould. An elongated element may extend through said at least one mould in the longitudinal direction of said at least one mould, around which element the ice cubes are formed in the mould. Said elongated element may comprise heating means. The device may comprise a number of moulds which are oriented in a matrix relative to each other. Conveying means may be provided for positioning a container under said at least one mould for collecting ice cubes formed by the device.

WO 2009/005339 further discloses a metering device for ice cubes, comprising a container for ice cubes and engaging means for engaging an ice cube and depositing it in a drinking container, wherein metering means are provided for metering one or more ice cubes to be deposited into the drinking container by mechanical means. Said metering means may comprise an engaging element for engaging at least one ice cube.

SUMMARY OF THE INVENTION

It would be advantageous to have an improved way of making ice. To better address this concern, a first aspect of the invention provides an apparatus for making ice cubes, comprising:

a plurality of elongated elements;

a plurality of mould parts that are movable with respect to the elongated elements, wherein the plurality of mould parts are movable to form a mould around a first elongated element of the elongated elements;

a controller configured to control a movement of the plurality of mould parts with respect to the elongated elements to:

move the mould parts forming the mould around the first elongated element apart once a first ice column has been formed in the mould, and form a mould around a second elongated element of the elongated elements.

This way, the ice column that has been formed around the first elongated element can be dispersed while a new ice column is generated in the mould around the second elongated element. The apparatus thus provides a more continuous supply of ice. The ice columns and elongated elements make it easier to handle the ice and to distribute ice cubes. The ice column may remain attached to the elongated element when the relevant mould parts move apart.

For example, once the ice column around the first elongated element has been used up and a new ice column has been formed in the mould around the second elongated element, the controller may be configured to move the mould parts forming the mould around the second elongated element apart and again form a mould around the first elongated element. Then the ice column formed around the second elongated element may be used while a new ice column is formed around the first elongated element.

The apparatus may further comprise an ice remover configured to remove the first ice column from the first elongated element while the mould is formed around the second elongated element. This provides a mechanical means to remove the first ice column from the first elongated element, while the mould formed around the second elongated element is available to generate a new ice column. This assists in making the dispersion of the ice automatic and/or making ice cubes available continuously.

The ice remover may be configured to move the ice column along the first elongated element in steps corresponding to a dimension of an ice cube. This facilitates distributing the ice in separate ice cubes.

The apparatus may comprise an ice breaker configured to break off an ice cube from the first ice column while the mould is being formed around the second elongated element. The ice breaker facilitates the distribution of the ice in small portions, i.e. cubes.

The ice remover may comprise a piston formed around the elongated element and movable along the elongated element. This is an efficient example implementation of the ice remover. The piston may be configured to push the ice column along the elongated element.

The apparatus may comprise an ice cube distributor arranged for receiving a portion of an ice column and delivering the portion of the ice column into a receptacle. This ice cube distributor facilitates the distribution of individual portions of the ice column, for example ice cubes, into a receptacle, such as a glass or other holder.

The apparatus may further comprise an alignment device configured to sequentially align different elongated elements with the ice cube distributor, and configured to align an elongated element around which an ice column has formed with the ice cube distributor. This is an efficient way to realize a continuous supply of ice, by aligning an elongated element having an ice column with the ice cube distributor, so that portions of the ice column may be received by the ice cube distributor for distribution into a receptacle.

The apparatus may comprise a first rigid element comprising a first mould part and a second mould part of the plurality of mould parts, wherein the first mould part is configured to be part of the mould formed around the first elongated element, and the second mould part is configured to be part of the mould formed around the second elongated element. This is an advantageous arrangement of the mould parts, as the first rigid element can be moved between the two positions to become part of two different moulds. For example, this allows a more compact construction. For example, the first mould part and the second mould part are arranged on different sides of the first rigid element.

The apparatus may comprise a second rigid element comprising a third mould part and a fourth mould part of the plurality of mould parts, wherein the third mould part is configured to be part of the mould formed around the first elongated element, and the fourth mould part is configured to be part of the mould formed around the second elongated element. This allows a construction in which the two moulds can be formed with only two rigid elements. Moreover, it allows more simple movements to form the moulds.

The mould parts may be movable at least by means of a rotational movement of the first rigid element and/or the second rigid element around an axis of rotation. The first elongated element and the second elongated element may be arranged around the axis of rotation. This allows for a compact construction.

The first mould part and the second mould part may be movable at least by means of a movement of the first rigid element towards the first elongated element and by means of a movement of the first rigid element towards the second elongated element. This allows to bring the rigid element with the mould part towards the relevant elongated element.

At least one of the mould parts may comprise refrigerating means for freezing liquid substance inside the mould and heating means for detaching an obtained ice column from the mould by melting. This is an efficient way to obtain an ice column and detach the mould parts from the ice. The heating means may comprise an electrical heating element, for a quick change from freezing mode to heating mode.

The mould around an elongated element may define a series of interconnected, hollow spaces. The mould may thus form a mould for forming an elongated ice column of interconnected ice cubes. Each hollow space may contain an ice cube connected to one or more other ice cubes.

The apparatus may comprise agitation means arranged for agitating the liquid mass while it is being refrigerated in the mould. This makes the ice more clear or transparent. For example, the elongated element is configured to agitate the liquid mass.

Each mould, when formed around an elongated element, may define a series of interconnected, hollow spaces for forming an elongated ice column of interconnected ice cubes.

In another aspect, the invention provides a method of making ice cubes. The method comprises controlling a movement of a plurality of mould parts with respect to a plurality of elongated elements, wherein the plurality of mould parts are moved to form a mould around a first elongated element of the elongated elements; and subsequently controlling a movement of the plurality of mould parts with respect to the elongated elements to:

move the mould parts forming the mould around the first elongated element apart once a first ice column has been formed in the mould, and form a mould around a second elongated element of the elongated elements.

The person skilled in the art will understand that the features described above may be combined in any way deemed useful. Moreover, modifications and variations described in respect of the system may likewise be applied to the method and vice versa.

BRIEF DESCRIPTION OF THE DRAWINGS

These and other aspects of the invention are apparent from and will be elucidated with reference to the embodiments described hereinafter in the drawings. Throughout the figures, similar items have been indicated by the same reference numerals. The figures are drawn schematically for illustration purpose, and may not be drawn to scale.

DETAILED DESCRIPTION OF EMBODIMENTS

The figures, discussed herein, and the various embodiments used to describe the principles of the present disclosure in this patent document are by way of illustration only and should not be construed in any way to limit the scope of the disclosure. Those skilled in the art will understand that the principles of the present disclosure may be implemented in any suitable method or any suitably arranged system or device.

Figure 1A:
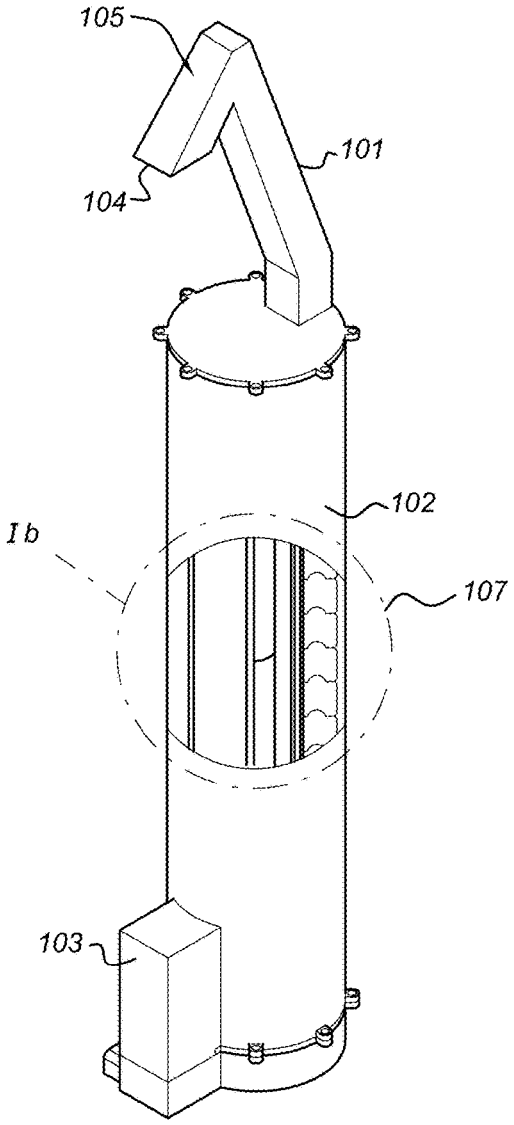
FIG. 1A shows a partly worked open an apparatus for making ice cubes.

FIG. 1A illustrates an apparatus for making and dispersing ice cubes. The apparatus comprises an ice cube distributor 105 and an ice making compartment 102. The apparatus further comprises a compartment for housing a control unit 103. The apparatus comprises an inlet for a liquid, typically water (not shown). This inlet may be connectable to the water supply system. Generated ice cubes may be dispersed via ice cube outlet 104 into a receptacle (not shown).

Figure 1B:
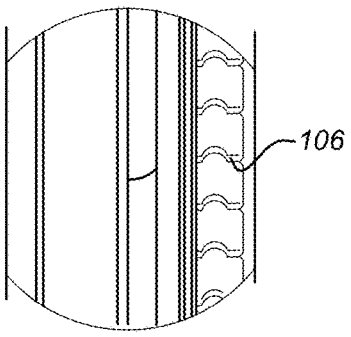
FIG. 1B shows an enlarged detail of the partly worked open apparatus of FIG. 1A.

FIG. 1B shows a worked open portion 107 of the apparatus of FIG. 1A. An interior of one of the mould parts 106 is illustrated.

Figure 2C:
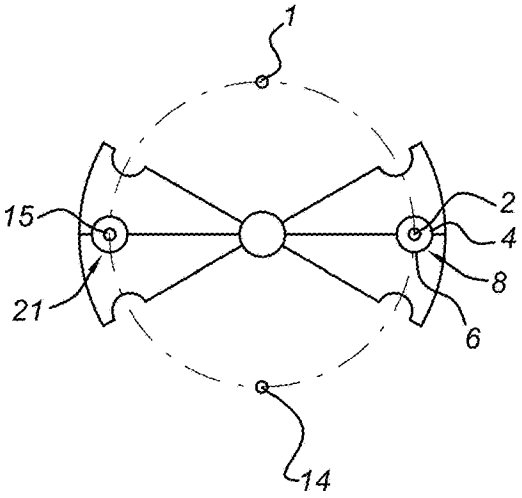
FIGS. 2A, 2B, and 2C show a cross section in axial direction of mould parts of an apparatus for making ice cubes, with differently positioned mould parts.
Figure 2B:
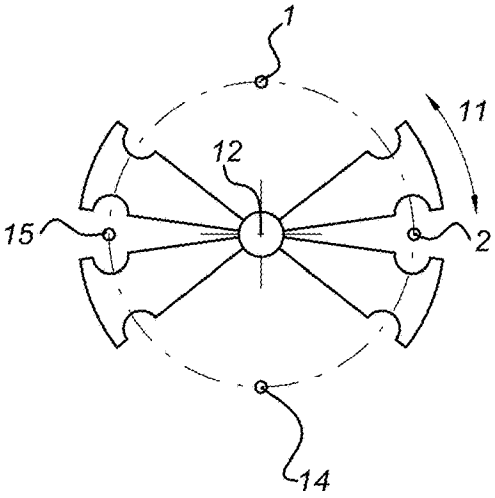
Figure 2A:
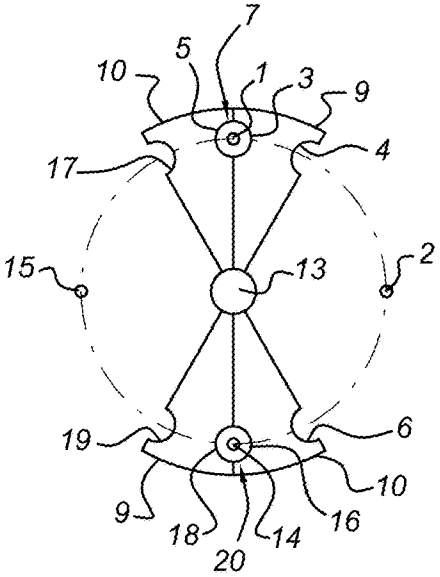

FIGS. 2A, 2B, and 2C show, schematically, a cross section of the internal part of the ice making compartment 102 of the apparatus for making ice cubes of FIG. 1. The Figure shows two rigid elements 9 and 10. These rigid elements 9, 10 are rotatably mounted on a shaft 13. More particularly, the rigid elements are rotatable around an axis of rotation 12, in the direction indicated by the arrow 11 in FIG. 2B. A plurality of elongated elements 1, 2, 14, and 15 are arranged around the shaft 13.

The rigid elements 9 and 10 each define a plurality of mould parts. For example, rigid element 9 comprises mould parts 3, 4, 18, and 19. Rigid element 10 comprises mould parts 5, 6, 16, and 17. Another embodiment, in which each rigid element defines only one mould part, is described elsewhere in this description.

The rigid elements 9 and 10 can be rotatably movable with respect to the elongated elements 1, 2. For example, as shown in FIG. 2A, the plurality of mould parts 3, 4, 5, 6, 16, 17, 18, 19 are movable to form a mould 7 around a first elongated element 1 of the elongated elements. As shown in FIG. 2C, the plurality of mould parts 3, 4, 5, 6, 16, 17, 18, 19 are also movable to form a mould around a second elongated element 2 of the plurality of elongated elements. As is clear from the drawings, not all mould parts need to be part of each mould. Moreover, more than one mould can be formed at the same time. For example, while mould parts 3 and 5 form mould 7 around elongated element 1, mould parts 16 and 18 form mould 20 around elongated element 14. FIG. 2B illustrates an intermediate position in which no mould is formed at all. As seen in FIG. 2B, the mould parts can rotate around an axis of rotation 12, which is perpendicular to the plane of the drawing. The direction of the rotation is indicated by arrows 11. By means of the rotational movement, the first mould part 3 and the second mould part 4 are movable at least by means of a movement of the first rigid element 9 towards the first elongated element 1 and by means of a movement of the first rigid element 9 towards the second elongated element 2.

The movement of the mould parts may be controlled by a control unit 103 (FIG. 1). This control unit 103 can be implemented using a programmed processor. The control unit 103 may also be implemented by mechanical means. The movement of the mould parts may be performed by any actuator, for example a servo motor (not shown).

The apparatus may comprise a supplying device (not shown) for supplying a liquid substance to at least one of the moulds 7, 20. Moreover, the mould parts, or the rigid elements defining the mould parts, may comprise refrigerating means to form an ice column inside the mould, and/or heating means to allow the mould parts to be released from the ice column.

The control unit may be configured to control the movement of the plurality of mould parts with respect to the elongated elements to move the mould parts 3, 5 forming the mould 7 around the first elongated element 1 apart once a first ice column 201 has been formed in the mould around the first elongated element 1. The control unit may be configured to control the movement of the plurality of mould parts with respect to the elongated elements to form a mould 8 around a second elongated element 2 of the elongated elements. This mould 8 may be closed while the mould parts 3, 5 forming the mould around the first elongated element are separated.

Figure 3C:
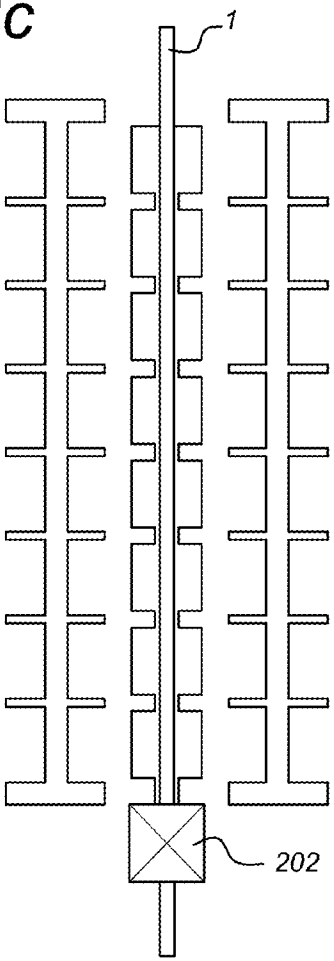
FIGS. 3A, 3B, 3C, 3D, and 3E show a cross section in longitudinal direction of mould parts of an apparatus for making ice cubes, with differently positioned components.
Figure 3B:
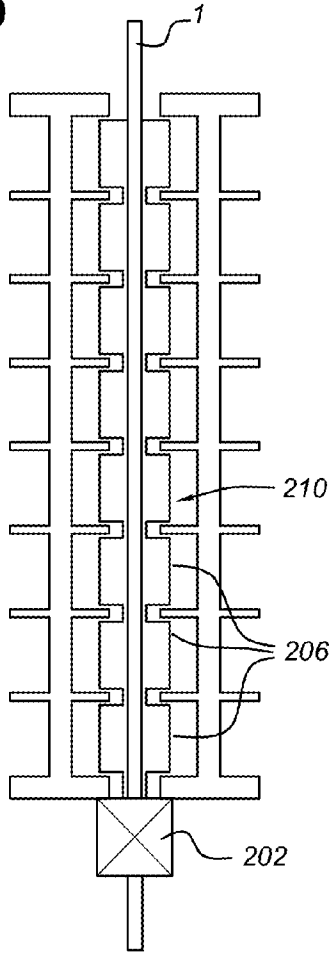
Figure 3A:
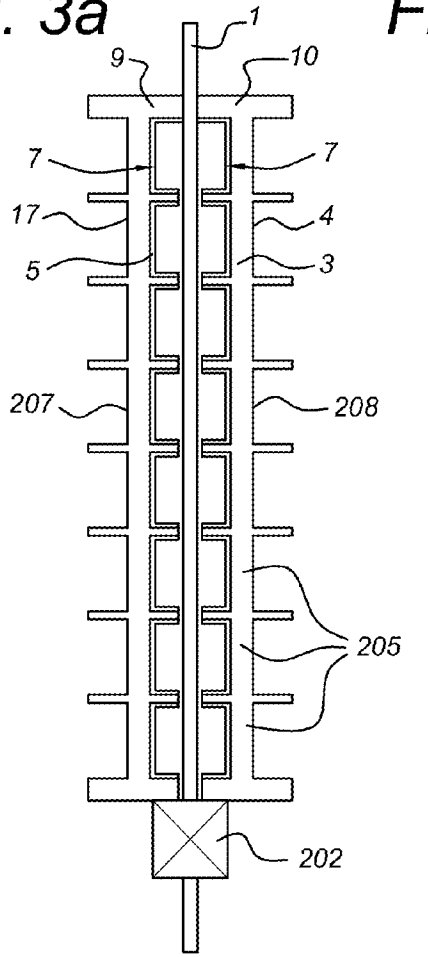

FIG. 3A to 3E show schematically a cross section in longitudinal direction through an elongated element 1 and a mould 7. In FIG. 3A, the mould is formed by the mould parts 3 and 5. A substantially closed mould is formed, wherein an ice column can be formed. The supplying device (not shown) supplies the liquid into the mould 7. The mould 7 may be a substantially closed mould, in the sense that the supplied liquid does not flow out of the mould. The rigid elements 9 and 10 may comprise refrigerating means to freeze the liquid inside the mould 7. The rigid elements 9 and 10 may comprise heating means to release the mould parts 3, 5 from the ice by melting, so that the mould parts 3, 5 can be moved apart. In FIG. 3B, it can be seen that the mould parts 3 and 5 have moved apart, releasing the ice column 201. In FIG. 3C, the mould parts 3 and 5 have been moved apart even more, so that the ice column 201 can be moved along the elongated element 1.

An ice remover 202 may be arranged to remove the first ice column 201 from the first elongated element 1. The ice remover can be configured to do this while the mould 8 is in place around the second elongated element 2. This way, ice can be removed from one elongated element while a new ice column is created around another elongated element.

Figure 3D:
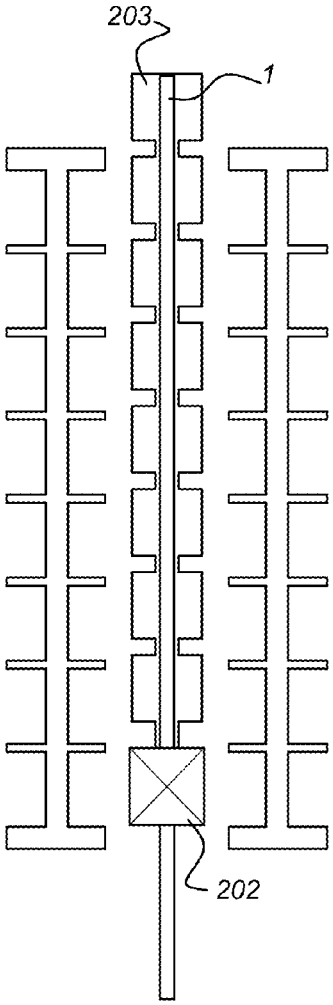
Figure 3E:
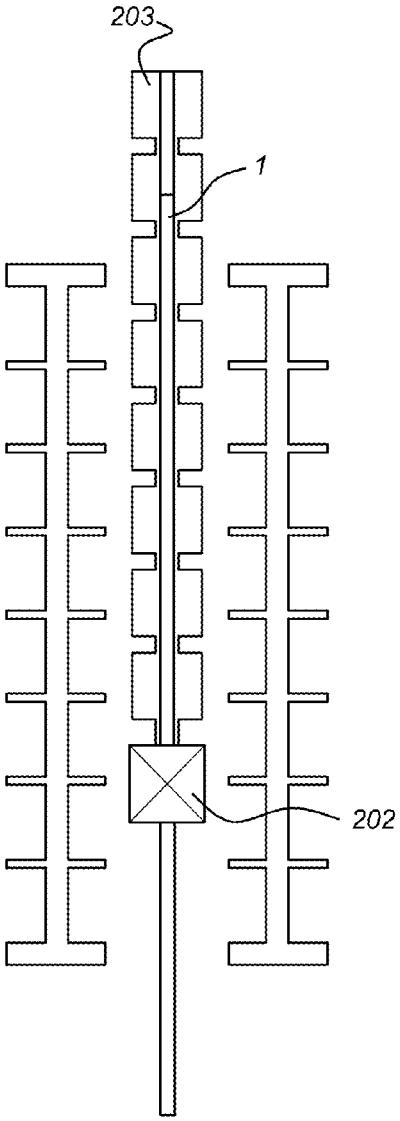

In FIGS. 3D and 3E, a situation is shown in which the ice remover 202 has moved the ice column 201 along the elongated element 1.

The ice remover 202 may be configured to move the ice column 201 along the first elongated element 1 in steps corresponding to a dimension of an ice cube 203. This makes it easier to break off one ice cube at a time, namely the topmost ice cube 203 of the ice column 201. This breaking may be performed manually with the hands of a user of the apparatus, for example. Alternatively, the apparatus may comprise an ice breaker (not shown) to break off an ice cube 204 from the first ice column 201 while the mould 8 is in place around the second elongated element 2. For example, the ice breaker may comprise a surface 101 to which the ice is pushed by the ice remover 202 under an angle of inclination that is not perpendicular, so that the top most ice cube 203 of the ice column 201 breaks off. For example, the angle of inclination is between 20 and 80 degrees, for example 45 degrees with respect to a normal of the surface 101.

As illustrated, the ice remover 202 may comprise a piston formed around the elongated element 1 and movable along the elongated element 1. The piston 202 may be configured to move under control of the control unit 103. An actuator, for example a servo motor, may provide the power needed for pushing the ice column 201 along the elongated element 1.

The ice remover 202 may be provided on each elongated element of the plurality of elongated elements. Alternatively, the same ice remover 202 may be used on different elongated elements. In such a case, mechanical components may be provided to bring the ice remover 202 from one elongated element to another elongated element.

The apparatus may comprise an ice cube distributor 105 arranged for receiving a portion of an ice column and delivering the portion of the ice column into a receptacle (not shown) and an alignment device (not shown) capable of sequentially aligning different elongated elements with the ice cube distributor, and configured to align an elongated element 1 around which an ice column 201 has formed with the ice cube distributor. For example, the ice breaker 101 may be part of the ice cube distributor 105. The ice cube distributor may have an opening mouth through which the ice cubes exit the apparatus, to fall into for example a receptacle that is positioned below the opening 104.

The alignment may be done e.g. by rotating and/or translating the constellation including all the elongated elements and mould parts to align the desired elongated element with ice column with the ice cube distributor 105. Alternatively, the ice cube distributor 105 may be movable, or comprise movable part, so that it can be aligned with the elongated elements. Still alternatively, the elongated elements may be movable, independently or together, with respect to the ice cube distributor 105.

Several mould parts 3, 4, 18, 19 may be defined by the shape of a single rigid element 9. The material of such a rigid element 9 can be for example metal. However, other materials are also possible, including plastic materials. The apparatus may comprise a first rigid element 9 comprising a first mould part 3 and a second mould part 4. In the configuration of FIG. 2A to 2C, the first mould part 3 is configured to be part of the mould 7 formed around the first elongated element 1, and the second mould part 4 is configured to be part of the mould 8 formed around the second elongated element 2.

The apparatus as shown comprises a second rigid element 10 comprising a third mould part 5 and a fourth mould part 6 of the plurality of mould parts. The third mould part 5 is configured to be part of the mould 7 formed around the first elongated element 1, and the fourth mould part 6 is configured to be part of the mould 8 formed around the second elongated element 2.

The rigid elements can be arranged to form several moulds at the same time. Therefore, multiple ice columns can be created at the same time. In FIG. 2A, moulds 7 and 20 are formed simultaneously around elongated elements 1 and 14, respectively. In FIG. 2C, moulds 8 and 21 are formed simultaneously around elongated elements 2 and 15, respectively.

As illustrated in FIG. 3A, the mould 7 around an elongated element 1 may define a series of interconnected, hollow spaces 205. This way, the ice column formed inside the mould by freezing the liquid, comprises an elongated ice column 201 of interconnected ice cubes 206. However, this is not a limitation. In an alternative embodiment, the mould could define, for example, a cylindrical ice column (not shown). The ice breaker could be configured to cut off ice cubes from the cylindrical ice column (not shown).

The apparatus may comprise agitation means for agitating the liquid mass while it is being refrigerated in the mould 7. The agitation means may comprise the elongated element 1. A vibrator (not shown) may be configured to, under control of the control unit 103, cause the elongated element 1 to vibrate during the freezing process.

Figures 4A, 4B, 4C, 5A, 5B, 5C, 5D:
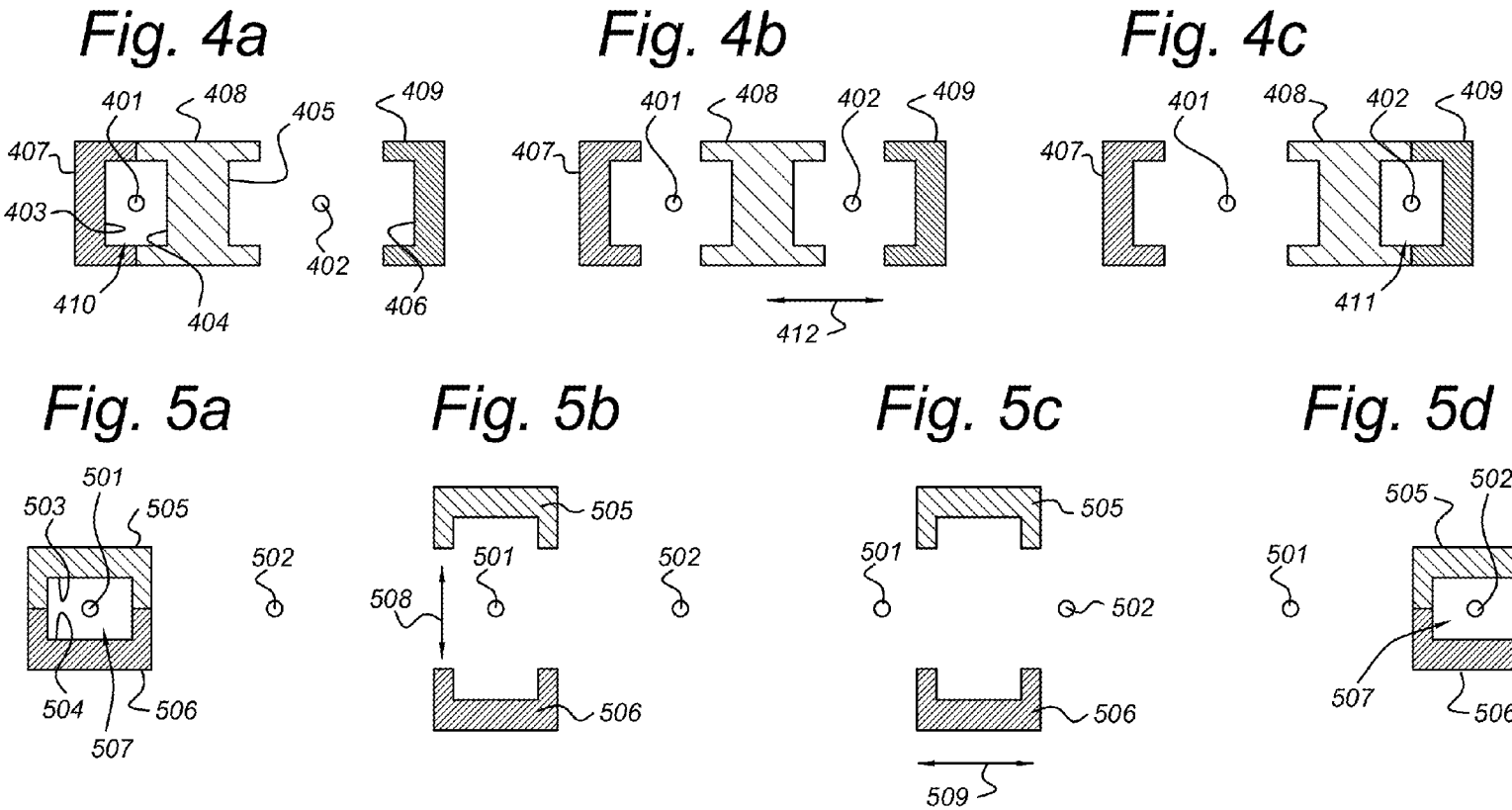
FIGS. 4A, 4B, and 4C show a cross sectional view of a part of an apparatus for making ice cubes with linearly moving mould parts.
FIGS. 5A, 5B, 5C, and 5D show a cross sectional view of a part of another apparatus for making ice cubes.

FIGS. 4A, 4B, and 4C illustrate another embodiment of an apparatus for making ice cubes. These figures show a cross section of elongated elements 401 and 402 and mould parts 403, 404, 405, and 406. The difference between the figures is that the mould parts are differently positioned with respect to the elongated elements. Rigid element 407 forms mould part 403; rigid element 408 forms mould parts 404 and 405; rigid element 409 forms mould part 406. The cross section shown is perpendicular to the longitudinal axis of the elongated elements 401 and 402. In FIG. 4A, a mould 410 is formed around elongated element 401, so that an ice column can be formed inside the mould 410 around elongated element 401. In FIG. 4B, the mould parts 403 and 404 have moved apart, so that the ice column (not shown) formed around elongated element 401 is released. The rigid element 408 moves further in the direction of elongated element 402, so that mould part 405, formed on opposite side of rigid element 408 compared to mould part 404, moves towards elongated element 402. Rigid element 409 moves towards elongated element 402, so that the edges of the two mould parts 405 and 406 touch each other, so that the mould 411 is closed. The liquid substance may be supplied by the supplying device into the mould 411, and the liquid substance may be frozen inside the mould 411 around the elongated element 402. When the ice column has formed in mould 411, and the ice formed around elongated element 401 has been removed (used up), the mould parts may be moved back to the position shown in FIG. 4A, and the ice column around elongated element 402 may be used (removed), while creating a new ice column around elongated element 401. The embodiment may be extended with more elongated elements and mould parts, for example by adding more rigid elements having the shape of rigid element 408.

The remaining general working and additional components of the apparatus of FIGS. 4A to 4C may be similar to those of the apparatus of FIGS. 1, 2A to 2C, and 3A to 3E. Therefore, they will not be described again in detail.

FIGS. 5A, 5B, 5C, and 5D illustrate another embodiment of an apparatus for making ice cubes. These figures also show a cross section that is perpendicular to elongated elements 501 and 502. The figures differ in the positions of the mould parts 503 and 504. The embodiment shows two mould parts. Mould part 503 is formed by rigid element 505, and mould part 504 is formed by rigid element 506. In FIG. 5A, the two mould parts 503 and 504 form a mould 507 around rigid element 501. In FIG. 5B, the mould parts 503 and 504 have moved apart to release the ice column (not shown) around elongated element 501. In FIG. 5C, it is shown that the mould parts 503 and 504 are on their way to the second elongated element 502. In FIG. 5D, the mould 507 has closed around elongated element 502. In this embodiment, the moulds can move in two directions: the first direction, indicated by arrow 508, towards and away from an elongated element, and in the second direction, indicated by arrow 509, from one elongated element 501 to another elongated element 502.

The remaining general working and additional components of the apparatus of FIGS. 5A to 5D may be similar to those of the apparatus of FIGS. 1, 2A to 2C, and 3A to 3E, and/or 4A to 4C. Therefore, they will not be described again in detail.

Figure 6:
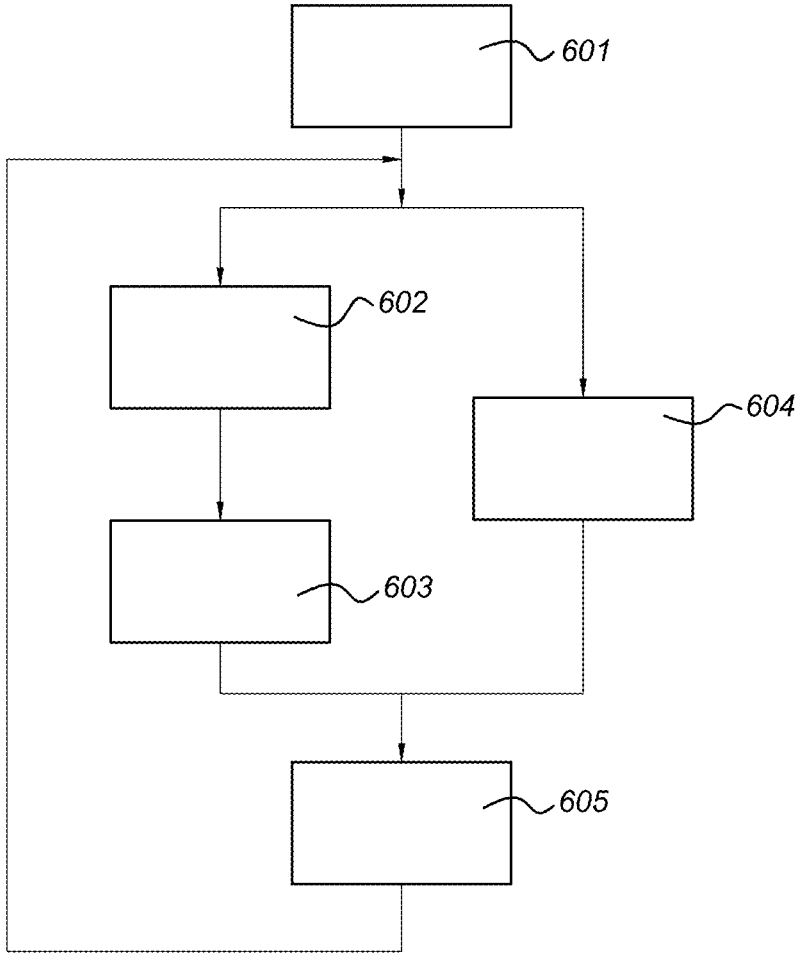
FIG. 6 shows a flowchart of a method of making ice cubes.

FIG. 6 illustrates aspects of a method of making ice cubes using, for example, one of the apparatuses set forth herein. The method may start with step 601 of controlling a movement of a plurality of mould parts with respect to a plurality of elongated elements, wherein the plurality of mould parts are moved to form a mould around a first elongated element of the elongated elements. Next, in step 602, a liquid may be provided into the mould. In step 603, the liquid may be frozen by application of a refrigerating element. In step 604, ice may be removed in stepwise manner from a second elongated element. It is noted that steps 602 and 603 may be performed in parallel to step 604. In step 605, the method controls a movement of the plurality of mould parts with respect to the elongated elements to move the mould parts forming the mould around the first elongated element apart and form a mould around a second elongated element of the elongated elements. After that, the process of steps 602, 603, and 604 is repeated with the roles of the two elongated elements and moulds exchanged. It is noted that the control unit 103 of one of the apparatuses for making ice cubes set forth herein, may be configured or programmed to cause the ice cube maker to perform the method set forth herein. Alternatively, mechanical components of the ice cube making apparatus may be configured so that the apparatus performs the method set forth herein.

The term "ice" as used herein refers to any frozen substance. The term is not limited only to frozen water or a frozen liquid, but it also includes frozen liquid substances such as foodstuffs.

The term "rigid" in "rigid element" should be interpreted broadly, to mean any element that is sufficiently rigid to be used as a mould for making ice cubes.

In the drawings, when a mould is formed around an elongated element, the elongated element is located substantially at the longitudinal axis of the mould. However, this is not a limitation. The elongated element may also be positioned coaxially, or closer to a side of the mould. The elongated element may also be positioned at the side of the mould, wherein the elongated element touches the mould.

As shown, for example, in FIG. 4A to 4C, but also applicable to other embodiments, the apparatus for making ice cubes may comprise a first element 407, a second element 408, and a third element 409. The apparatus may comprise any number of elements. The elements 407, 408, 409 may be movable relative to each other in the direction indicated by arrow 412. The elements may be further movable in any other direction. Any of the other elements may be movable with respect to any of the other elements in any direction in such a way that it makes possible for an element to approach another element or to move apart from that element. For instance, the second element 408 may be fixed and the first 407 and the third 409 elements and the elongated elements 401, 402 may be movable each one of them towards and away from the second element 408. In FIG. 4A, the three elements 407, 408, 409 are shown in a condition in which the first element 407 and the second element 408 touch each other and the second element 408 and the third element 409 are apart from each other. The first element 407 and second element 408 may define at least one substantially closed space wherein ice may be formed. The second element 408 and third element 409 may be apart from each other so that ice that has formed around elongated element 402 may be extracted. Some of the elements may be movable in such a way that at least another working position is possible. To reach this second working position, shown in FIG. 4C, it may be possible to move apart from each other the first element 407 and the second element 408, so that the mould 410 is opened and the ice around the elongated element 401 is released and may be extracted. The second element 408 and the third element 409 may be moved together in such a way that they define at least one substantially closed space wherein ice may be formed around elongated element 402.

Any number of moulds may be defined, in this way, ice may be produced in several closed spaces at the same time and at the same time ice may be extracted from several open spaces.

It should be noted that the above-described embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The mere fact that certain measures are recited in mutually different dependent claims does not indicate that a combination of these measures cannot be used to advantage.

The invention claimed is:

1. An apparatus for making ice cubes, comprising:
- a plurality of elongated elements;
- a plurality of mould parts that are movable in a transverse direction with respect to the elongated elements, wherein the plurality of mould parts are movable towards the elongated elements to form a mould closed around a first elongated element of the elongated elements so as to enclose the first elongated element;
- a control unit configured to control a movement of the plurality of mould parts with respect to the elongated elements to:
  - move the mould parts forming the mould apart once a first ice column has been formed in the mould around and on the first elongated element, and
  - form a mould around a second elongated element of the elongated elements.

2. The apparatus according to claim 1, further comprising an ice remover configured to remove the first ice column from the first elongated element while the mould is in place around the second elongated element.

3. The apparatus according to claim 2, wherein the ice remover is configured to move the ice column along the first elongated element in steps corresponding to a dimension of an ice cube.

4. The apparatus according to claim 1, further comprising an ice breaker to break off an ice cube from the first ice column while the mould is in place around the second elongated element.

5. The apparatus according to claim 2, wherein the ice remover (202) comprises a piston formed around the first elongated element (1) and movable along the first elongated element (1) to remove the ice column from the first elongated element.

6. The apparatus according to claim 1, further comprising an ice cube distributor (105) arranged for receiving a portion of an ice column and delivering the portion of the ice column into a receptacle, and an alignment device capable of sequentially aligning different elongated elements with the ice cube distributor, and configured to align the first elongated element (1) around and on which the ice column (201) has formed with the ice cube distributor.

7. The apparatus according to claim 1, wherein the apparatus comprises a first rigid element comprising and defining a first mould part and a second mould part of the plurality of mould parts, wherein the first mould part is configured to be part of the mould formed around and enclosing the first elongated element, and the second mould part is configured to be part of the mould formed around the second elongated element.

8. The apparatus according to claim 7, wherein the apparatus comprises a second rigid element comprising and defining a third mould part and a fourth mould part of the plurality of mould parts, wherein the third mould part is configured to be part of the mould formed around and enclosing the first elongated element, and the fourth mould part is configured to be part of the mould formed around the second elongated element.

9. The apparatus according to claim 7, wherein the mould parts are movable at least by means of a rotational movement of the first rigid element and/or the second rigid element around an axis of rotation, and the first elongated element and the second elongated element are arranged around and parallel to the axis of rotation.

10. The apparatus according to claim 7, wherein the first mould part and the second mould part are movable at least by means of a movement of the first rigid element towards the first elongated element and by means of a movement of the first rigid element towards the second elongated element.

11. The apparatus according to claim 1, wherein at least one of the mould parts comprises refrigerating means for freezing liquid substance inside the moulds (8, 8) and heating means for detaching the obtained ice column from the moulds by melting.

12. The apparatus according to claim 11, wherein said heating means comprises an electrical heating element.

13. The apparatus according to claim 1, wherein the mould (7) around the first elongated element (1) defines a series of interconnected, hollow spaces (205) for forming the elongated ice column (201) of interconnected ice cubes (206) in said interconnected hollow spaces.

14. The apparatus according to claim 1, further comprising agitation means for agitating a liquid mass while the liquid mass is being refrigerated in the moulds.

15. A method of making ice cubes, comprising:

controlling a movement of a plurality of mould parts in a transverse direction with respect to a plurality of elongated elements, wherein the plurality of mould parts are moved to form a mould around a first elongated element of the elongated elements; so as to enclose the first elongated element and subsequently controlling a movement of the plurality of mould parts with respect to the elongated elements to:

move the mould parts forming the mould apart once a first ice column has been formed in the mould, and form a mould around a second elongated element of the elongated elements.

16. The apparatus according to claim 2, further comprising an ice breaker to break off an ice cube from the first ice column while the mould is in place around the second elongated element.

17. The apparatus according to claim 8, wherein the mould parts are movable at least by means of a rotational movement of the first rigid element and/or the second rigid element around an axis of rotation, and the first elongated element and the second elongated element are arranged around and parallel to the axis of rotation.

18. The apparatus according to claim 7, wherein the mould parts are movable at least by means of a rotational movement of the first rigid element and the second rigid element around an axis of rotation, and the first elongated element and the second elongated element are arranged around and parallel to the axis of rotation.

19. The apparatus according to claim 7, wherein the mould parts are movable at least by means of a rotational movement of the first rigid element around an axis of rotation, and the first elongated element and the second elongated element are arranged around and parallel to the axis of rotation.

20. The apparatus according to claim 7, wherein the mould parts are movable at least by means of a rotational movement of the second rigid element around an axis of rotation, and the first elongated element and the second elongated element are arranged around and parallel to the axis of rotation.

* * * * *